United States Patent [19]

Diehl

[11] 4,381,653

[45] May 3, 1983

[54] ARTICLE SIMULATING BODY APPENDAGE MOVEMENTS OF INSECT

[76] Inventor: Walter Diehl, Flüggenstr. 12, 8000 Munich 19, Fed. Rep. of Germany

[21] Appl. No.: 245,843

[22] Filed: Mar. 20, 1981

[30] Foreign Application Priority Data

Mar. 27, 1980 [DE] Fed. Rep. of Germany ..... 3011923
Mar. 27, 1980 [DE] Fed. Rep. of Germany ... 8008495[U]

[51] Int. Cl.[3] ..... A44C 25/00

[52] U.S. Cl. ..... 63/2; 63/23; 63/31

[58] Field of Search ..... 63/2, 20, 23, 31; 46/124, 126

[56] References Cited

U.S. PATENT DOCUMENTS

| | | | |
|---|---|---|---|
| 365,853 | 7/1887 | Palmer | 63/2 |
| 737,337 | 8/1903 | Cairns | 46/124 |
| 2,090,106 | 8/1937 | Carlson | 46/124 X |
| 4,034,573 | 7/1977 | Elkaim | 63/31 |
| 4,245,486 | 1/1981 | Matsumoto et al. | 63/31 |
| 4,270,366 | 6/1981 | Green | 63/2 |

*Primary Examiner*—F. Barry Shay
*Attorney, Agent, or Firm*—Sughrue, Mion, Zinn, Macpeak and Seas

[57] ABSTRACT

An article of jewellery, especially in the shape of a butterfly or insect has two attachments, one for each end of a chain or a string. The attachments are fixed to the free ends of inherently rigid wires, the other ends of said wires being fastened to a body of said article of jewellery in such a way that they articulate freely with said body. An eye or sleeve encircling each one of said wires and being slideable along these wires is fixed to one end of an elongated part of a pair of such elongated parts, the other ends of the latter being fastened to the body of the article of jewellery in such a way that they articulate freely with said body, the points of attachment of said elongated parts on said body being spaced apart from the points of attachment of said wires on said body. This construction allows a movement between different parts of the article of jewellery when the wearer of the article of jewellery moves, creating interesting changes in the contour of the article of jewellery.

12 Claims, 4 Drawing Figures

ARTICLE SIMULATING BODY APPENDAGE MOVEMENTS OF INSECT

The innovation relates to an article of jewellery. Articles of jewellery which are worn around the neck of their wearer at the ends of a chain, a string or a circlet and which one generally subsumes under the term neck ornament are for the most part rigid structures or arrangements where different parts hang freely. In such a construction there is a certain degree of mobility between the different parts of the articles of jewellery which, especially if these are larger, allows them to adjust better to the wearer and thus to appear more live and interesting. There is, however, no real adjustment to the movements of the person wearing the jewellery.

The present invention is based on the object of creating an article of jewellery that is itself moved by the movements of the person wearing it. This objective is established according to the invention with an article of jewellery, especially in the shape of a butterfly or insect, having two attachements—one for each end of a chain, a string or a circlet—in that the attachments are fixed to the free ends of inherently rigid first wires, that the other ends of the first wires articulate freely with a body of the article of jewellery or a part connected rigidly to this, and that, encircling each of the first wires and being freely slidable along these, there is a first eye or sleeve which is fixed to one end of a first elongated part, the other end of the latter articulating freely with a point of the body spaced apart from the attachment point of the corresponding first wire, or with a part connected rigidly to said body. This construction allows the article of jewellery to move at the neck when the wearer moves; especially on bending, breathing in and out and on moving the arms the angle of inflection of the flexible suspension arrangement changes, so that the eyes or sleeves and thus the elongated parts—which can be the wings of the insect—connected with these are moved along the first wires, which in turn can serve as the insect's feelers. As a result of this change in profile, which with a design as butterfly or insect corresponds to a movement of the wings, the contour of the article of jewellery changes. This increases its attractiveness and the attention paid to it and thus also to the wearer of the article of jewellery.

By the term "wire" or "wires" is to be understood, within the framework of this application, any straight or also curved, elongated element which has, at least in the region along which the the eyes or sleeves are supposed to be movable, an essentially uniform diamater. Rod-shaped or solid or hollow cylindrical elements are especially suitable here. By the term "inherently rigid" a natural stability is to be understood, of such a nature that the article of jewellery does not itself undergo any permanent deformations, especially bending, as a result of the movements of the wearer or its own weight.

According to a preferred embodiment of the article of jewellery a second, preferably also an inherently rigid wire, forms in each case the first elongated part, there being, encircling each of the second wires and being freely slidable along these, a second eye or sleeve which is fixed to one end of a second elongated part, the other end of the latter articulating freely with a point of the body spaced apart from the attachment point of the corresponding second wire, or with a part connected rigidly to said body. By designing the article of jewellery in this way one obtains particularly effective, delicate filigree silhouettes, for example in the shape of beetles or insects.

In a further development of this design according to a particularly favourable embodiment a third wire can form in each case the second elongated part, there being, encircling each of the third wires and being freely slidable along these, a third eye or sleeve which is fixed to one end of a third elongated part, the other end of the latter articulating freely with a point of the body spaced apart from the attachment point of the corresponding third wire, or with a part connected rigidly to said body. This procedure can in principle be further repeated, with a fourth wire forming the third elongated part and being encircled by a fourth eye or sleeve which is fixed to one end of a fourth elongated part, the other end of the latter articulating freely with a point of the body spaced apart from the attachment point of the corresponding fourth wire, or with a part connected rigidly to said body, etc.

According to a further advantageous development, the second eye or sleeve and/or third eye or sleeve and/or further eyes or sleeves encircle, instead of the second, third or further wire, likewise the first wire. It is especially advantageous here if the second and/or third eye or sleeve and perhaps further eyes and sleeves are arranged in their numerical sequence, outside the first eye or sleeve, on the first wire. According to an alternative development it is also possible for the second and/or third eye or sleeve and any further eyes or sleeves to be arranged on the inside of a first eye or sleeve. By "outside" is meant here exterior to the first eye or sleeve as seen from the attachment of the first wire to the body of the article of jewellery or a part connected rigidly to the body, while the term "inside" means between this point of attachment and the first eye or sleeve.

If at least one of the elongated parts, or a pair of elongated parts, is of laminar design, movement of the same is especially obvious. If the article of jewellery is designed as an insect or butterfly, one gets the impression of wings which open to a greater or lesser degree in accordance with the movements of the wearer.

It is especially favourable if the attachment points of the first longitudinal parts are displaced with respect to the corresponding attachment points of the first wires, and/or the attachment point of the second elongated parts with respect to the attachment points of the second wires, and/or the attachment points of the third or further movable parts with respect to the attachment points of the third or further wires, the displacement being in each case in a direction which coincides with the direction of gravity when the wearer of the article of jewellery is standing.

If the elongated parts are of laminar design, it is particularly expedient to attach the eyes or sleeves on their underside. It is advantageous to have the attachments of the wires and laminar parts arranged symmetrical to the longitudinal axis of the body.

It has proven to be favourable if the wires are attached to inherently rigid prolongations extending from the body. The prolongations are expediently attached symmetrical to the longitudinal axis of the body and/or at one end of the same. According to an expedient development the wires are slidably mounted on the prolongations by means of eyes at the ends of the wires. Alternatively, the prolongations can have eyes at their ends, through which the wires can slide. It is a good idea to provide thickenings at the ends of the prolongations and/or wires, so as to prevent the wires or prolongations from sliding out.

It is advantageous to attach other parts of the article of jewellery to the body at the point of attachment of at least one of the laminar parts, at least one of these further parts articulating also with the laminar part itself in the area disposed away from the point of attachment.

In order to further enhance the optical attractiveness of the article of jewellery, it is expedient to have at least one further part freely suspended, advantageously at that end of the body which points down when the article of jewellery is being worn. It is advantageous if, in comparison with the other parts of the article of jewellery, this part is of relatively large mass, so that it functions as a weight and has the effect of always trying to pull the article of jewellery downwards. In a particularly advantageous development the prolongations are fixed to the end of the body opposite to where the weight is attached. It is advantageous to have the structural elements of the article of jewellery running essentially in one plane. Further details and advantages of the invention are apparent from the accompanying drawings of preferred embodiments.

Figure 1:
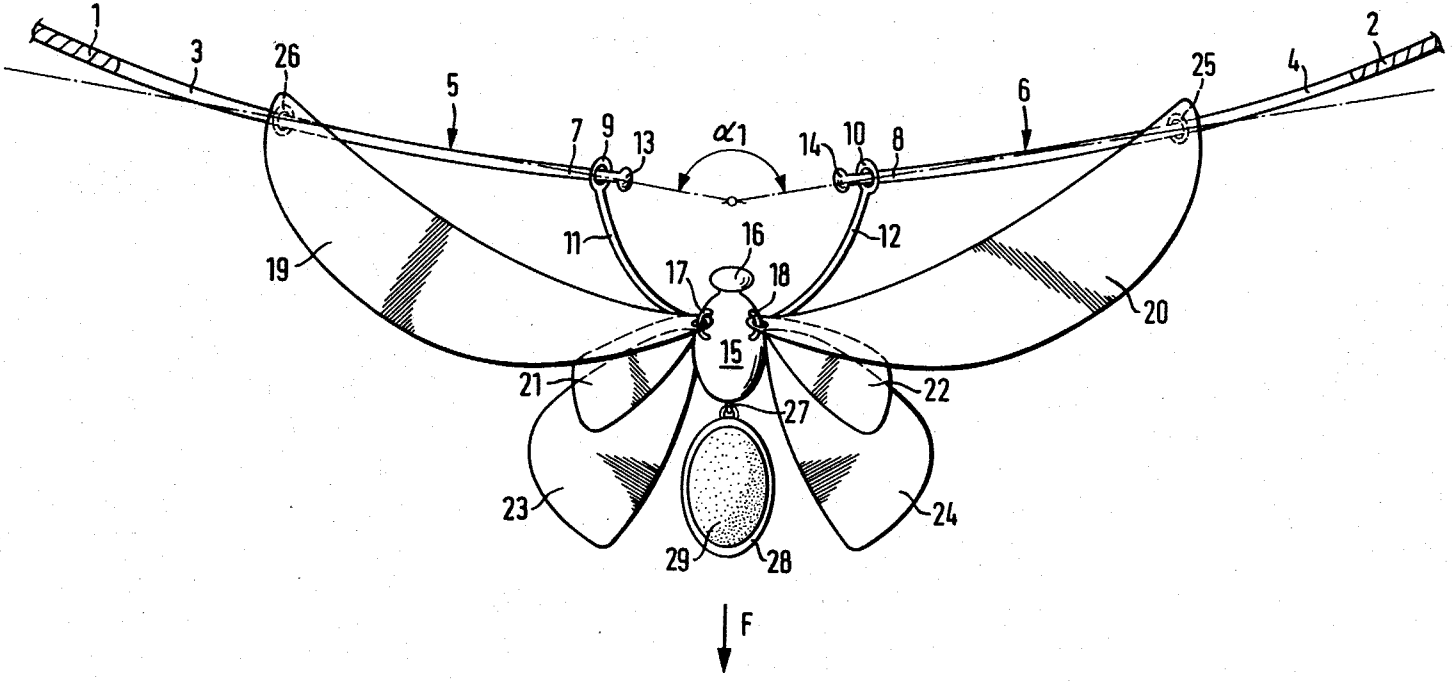
FIG. 1 shows a top view of a first embodiment of the article of jewellery.
Figure 2:
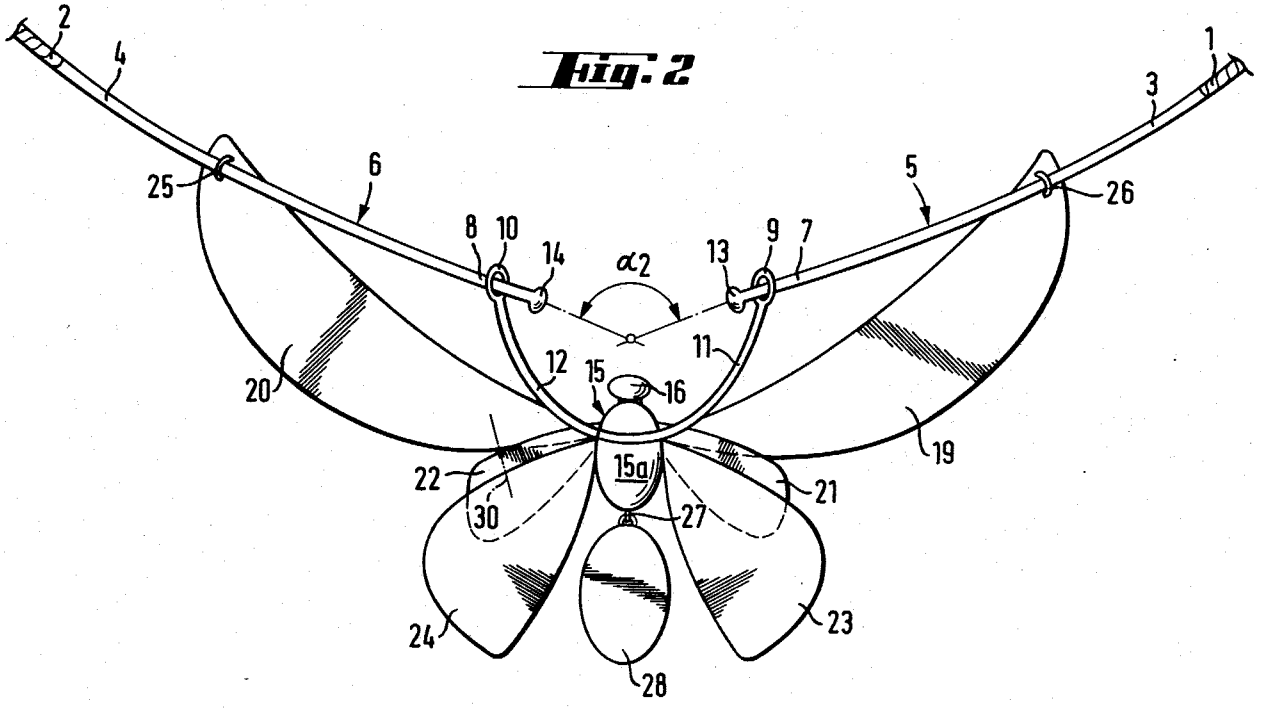
FIG. 2 shows the under view of the article of jewellery shown in FIG. 1.

FIGS. 1 and 2 show the article of jewellery in the form of a butterfly. At the ends 1 and 2 of a string not shown in detail the free ends 3 and 4 of wires 5 and 6 are attached in a manner not shown in more detail. Any conventional joint can be used for the attachment. The wires 5 and 6 extend with their inner ends 7 and 8 respectively through eyes 9 and 10 which are fixed to the free ends of prolongations 11 and 12. Knob-like thickenings 13 and 14 at the inner ends 7 and 8 of wires 5 and 6 prevent the inner ends 7 and 8 from slipping through the eyes 9 and 10. The prolongations 11 and 12 consist of a piece of wire bent in an arc and, as can be seen in FIG. 2, fixed to the rear side 15*a* of the body 15. The prolongations 11 and 12 form the butterfly's feelers. In the region of the body 15 between the prolongations 11 and 12 there is in addition a head piece 16 attached. Fixed to the top side of the body 15 are brackets 17 and 18, in which the uppermost of three pairs of wings of the butterfly are hung, these being formed by the laminar parts 19 and 20, 21 and 22, and 23 and 24. The laminar parts 21,22 and 23,24, which form the under wing pairs of the butterfly, are in this case fixed rigidly to the body 15. The laminar parts 19 and 20, which form the uppermost pair of wings and thus come to lie above the other two pairs of wings, are of elongated design and have on the underside of their outer ends, as can be seen from FIG. 2, eyes 25 and 26 through which the wires 5 and 6 freely pass. At the lower end of the body 15, i.e. at that end which points down when the article of jewellery is being worn, a setting 28 is suspended by a ring 27 in such a way that it can swing freely in the ring. As can be seen from FIG. 1, the setting in the example shown holds a stone or a gem 29 at the front. Setting 28 and gem 29 are of relatively large mass so that, on account of the force of gravity in the direction of arrow F, they have the effect of trying to pull the butterfly likewise in the direction of arrow F.

The article of jewellery is put together as follows: First of all the head 15 is provided with brackets 17,18 and ring 27, and perhaps also with head piece 16. The piece of wire with the two eyes 9 and 10 at its ends is then fixed to the underside 15*a* of the body. Into the brackets 17 and 18 and the ring 27 the parts 19 and 20 and 28 are then inserted. Subsequently the free ends 3 and 4 of wires 5 and 6 are pushed through the eyes 9 and 10, care being taken that the free ends 3 and 4 also pass through eyes 25 and 26. As soon as this has been done, the ends 1 and 2 of the string are secured and the article of jewellery can be worn. As a result of the movements of the wearer wires 5 and 6 are moved such that the angle contained by them changes. In the case of FIG. 1, for example, the angle $\alpha_1 = 160°$, and in the case of FIG. 2 $\alpha_2 = 115°$. The eyes 9 and 10 are large enough to allow these movements without difficulty and without bending the prolongations 11 and 12. These changes in the angle contained by wires 5 and 6 have the effect of raising or lowering the eyes 25 and 26 on the underside of the ends of laminar parts 19 and 20, the eyes thereby being moved along the wires 5 and 6. This raising and lowering of the laminar parts 19 and 20, which form the uppermost wings of the butterfly, changes its outward appearance, making the butterfly appear alive and to be moving its wings while the wearer moves.

In the embodiment described above only the uppermost wings 19 and 20 move. One can, however, as shown in FIG. 2 by the dashed connection 30, connect the wings of the separate wing pairs with one another in such a way that, together with the movement of the upper wing 20, for example also the lower wing 24 is moved, the latter being hung freely in this case in the bracket 18. It is also possible to connect in this case wing 20 with wing 22, and/or this with wing 24, in which case all these wings are hung freely in bracket 17 or 18.

Figure 3:
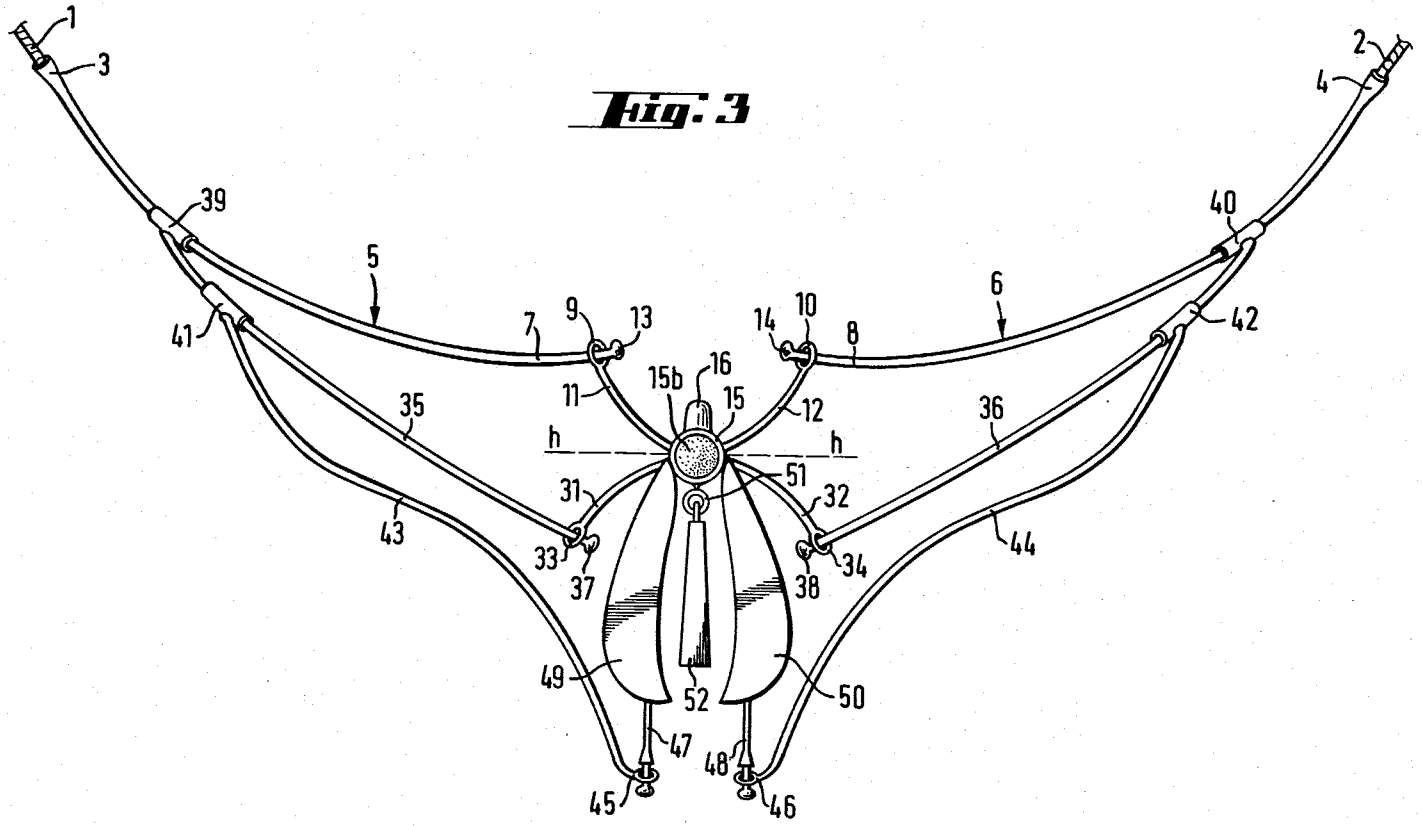
FIG. 3 shows a top view of a further embodiment of the article of jewellery.

The article of jewellery shown in FIG. 3 corresponds in its construction, with respect to structural elements 1 to 16*a*, the embodiment shown in FIG. 1. Only the body 15 is smaller here and designed as a setting, holding on its front side a stone or gem 15*b*. Attached to the body 15 is a further pair of prolongations 31, 32, which, with respect to the middle line h-h—which is approximately horizontal when the article of jewellery is being worn—are approximately symmetrical to the prolongations 11 and 12. At the ends of prolongations 31 and 32 there are eyes 33 and 34, through which the end regions of second wires 35 and 36 extend, the latter having spherical thickenings 37 and 38 at their ends, so that, as in the case of eyes 9 and 10 and knob-like thickenings 13 and 14, simple articulating joints are formed. At the other ends of wires 35, 36 sleeves 39 and 40 are attached in such a way as to encircle the first wires 5 and 6 and to be slidable along these. The second wires 35 and 36 are in turn encircled by second sleeves 41 and 42 which can slide along them and are fixed to the ends of third wires 43, 44. The wires 43 and 44, which are S-shaped, have at their other ends eyes 45, 46 which are fixed to two parallel, rigid prolongations 47, 48 extending from the body perpendicular to the line h—h. This is effected in that the prolongations 47, 48 have in their end regions a section of reduced diameter, onto which the eyes 45, 46 are freely pushed, these then being prevented from sliding off again by providing knob-like thickenings at the ends of the prolongations 47, 48. Articulated connections are thus formed here too, which allow relative movements between the wires 43 and 44 and the prolongations 47 and 48. Also fixed to the body 15 are two laminar parts 49, 50, designed in the form of insect wings and extending in the direction of the prolongations 47, 48. The laminar parts 49 and 50 can be movably joined to the body 15. They can, however, also be rigidly attached and connected to the prolongations 47 and 48 in order to strengthen the latter. It is also possible to attach the prolongations 47 and 48 to the laminar parts 49, 50 and not directly to the body 15. Between the laminar parts 49, 50 a narrow, circular-sector-like part 52 is swingably attached by means of an eye 51 to the center lower end of the body 15. When the wearer of the article of jewellery moves, the angle contained by the inherently rigid wires 5 and 6, which in this case are curved, changes, as a result of which the sleeves 39 and 40 likewise move and together with them the wires 35 and 36, the movement of the latter in turn causing sleeves 41 and 42 to move along them and thus make wires 43 and 44 move too. The filigree-like contour of the insect as produced by the wires thus changes continuously, which enhanced the aesthetic attractiveness of the article of jewellery and ensures that it adjusts optimally to the contour of the neck and breast region of the wearer.

It is also possible to modify the article of jewellery shown in FIG. 3 in that the sleeves 41, 42 fixed to the ends of wires 43, 44 are arranged to slide along wires 5 and 6—inside or outside sleeves 39 and 40—instead of encircling wires 35 and 36 as shown in FIG. 3.

Figure 4:
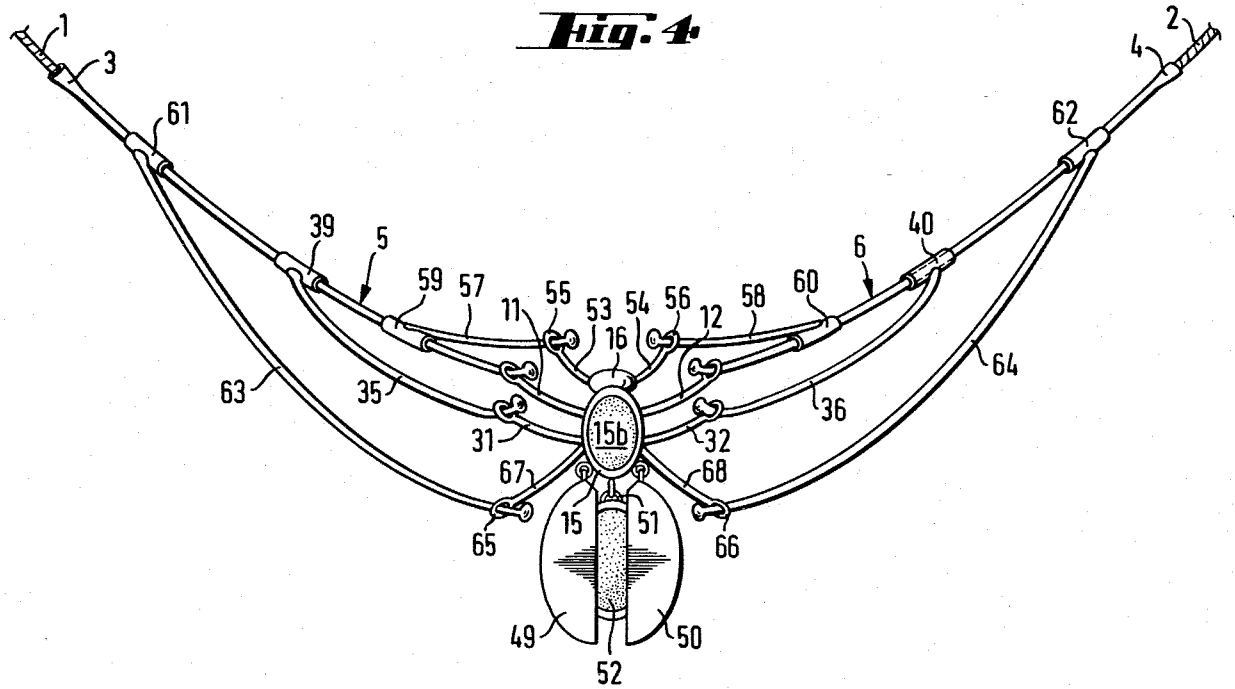
FIG. 4 shows a top view of a third embodiment of the article of jewellery.

The article of jewellery shown in FIG. 4 corresponds, in so far as its parts are provided with the same reference numerals, to that of FIG. 3 as regards its principle construction. The head piece 16 has an additional two feeler-like rigid prolongations 53, 54 fixed to it, which have eyes 55, 56 at their ends. Extending through the eyes 55, 56 are the end parts—the ends being provided with knob-like thickenings—of wires 57, 58, which have at their other ends sleeves 59, 60 that are slidable, inside the sleeves 39, 40, along the wires 5 and 6. Outside sleeves 39 and 40 there are further sleeves 61, 62, also slidable along wires 5 and 6, which are fixed to the outer ends of wires 63, 64. The arc-shaped wires 63, 64 extend at their other end through eyes 65, 66, which are fixed to the free ends of leg-like prolongations 67, 68 extending obliquely backwards from the body 15. By movement of the different sleeves along wires 5 and 6 the article of jewellery adjusts to the different movements of the wearer, as described in the foregoing cases.

It is of course possible to use other sliding pieces instead of the sleeves, or to substitute the joints and joint connections—formed in the examples shown by means of eyes and knob-like thickenings at the ends of the wires passing through these eyes, with other joint connections that give the desired degree of freedom, even if the joint connections described previously are especially preferable. As regards the material used for the separate parts, there is basically no limitation. The same applies for the shapes of the same, as far as the artistic, aesthetic side is concerned and not the technical effect. This means that the individual designer or artist has a large amount of play. It is preferable to use precious metals for the individual structural elements, these being provided with jewels or inlays of other valuable materials such as precious and semi-precious stones, gems, ivory etc., or substitutes for these.

In the article of jewellery shown in FIG. 4 it is of course also possible for the sleeves 61 and 62 and/or also sleeves 59 and 60 to slide along the wires 35 and 36. All the structural elements referred to in the above as wires or elongated parts can, in those areas where no sleeves or eyes slide along them, be of laminar design or be provided with laminar elements.

I claim:

1. An article of jewellery, especially simulating an insect such as a butterfly, comprising:

(a) a body member (15), (b) a pair of first rigid wires (11,12) resembling insect feelers fixedly secured to the body member and extending outwardly from a forward portion thereof in a generally U configuration, (c) a pair of second rigid elongated wires (5,6) having outer ends (3,4) attached to ends (1,2) of a necklace, (d) first joint means (9,10; 13,14) individually and freely articulating inner ends of the second wires to free ends of the first wires, (e) a pair of equally configured elongate members, (f) second joint means individually articulating an inner end of each elongate member to the body member, and (g) coupling means individually and slidably connecting an outer end of each elongate member to the second wires at points laterally remote from the body member, whereby upon movement of a wearer the elongate members hinge at their inner ends proximate the body member and slide on the second wires at their outer ends, thereby simulating body appendage movements of an insect.

2. An article of jewellery according to claim 1 wherein each elongate member comprises a wing-shaped foil (19,20).

3. An article of jewellery according to claim 2 further comprising at least one additional pair of wing-shaped foils attached to and extending outwardly from the body member.

4. An article of jewellery according to claim 3 wherein the additional foils are articulatingly attached to the body member, and are also connected to the elongate members for movement therewith.

5. An article of jewellery according to claim 1, 2, 3 or 4, further comprising a pendant member attached to and depending downwardly from the body member.

6. An article of jewellery according to claim 1, wherein:

(a) the elongate members comprise wires (35,36), (b) the coupling means comprises sleeves (39,40), and further comprising: an additional pair of S-shaped wires (43,44) having inner ends articulated to the body member and outer ends slidably coupled to the elongate members.

7. An article of jewellery according to claim 6, wherein the second joint means comprises wire members (31,32) fixedly secured to the body member and extending outwardly therefrom, and eyelets (33,34) on outer ends of said wire members.

8. An article of jewellery according to claim 1, wherein the S-shaped wires are individually articulated to the body member through a pair of intermediate wing-shaped foils depending downwardly therefrom.

9. An article of jewellery according to claim 1, wherein:

(a) the elongate members comprise wires (35,36), (b) the coupling means comprises sleeves (39,40), and further comprising: an additional pair of elongated wire members (63,64) having inner ends articulated to the body member and outer ends slidably coupled to the second wires.

10. An article of jewellery according to claim 9, wherein the second joint means comprises wire members (31,32) fixedly secured to the body member and extending outwardly therefrom, and eyelets (33,34) on outer ends of said wire members.

11. An article of jewellery according to claim 9 or 10, further comprising:

(a) a pendant member attached to and depending downwardly from the body member, and (b) a pair of wing-shaped foils (49,50) attached to and depending downwardly from the body member, and partially overlying the pendant member.

12. An article of jewellery according to claim 9 or 10, further comprising a pair of third wires (53,54) extending outwardly from a head portion (16) of the body member above the first wires, and a pair of fourth wires (57,58) having inner ends articulated to free ends of the third wires and outer ends slidably coupled to the second wires.

* * * * *